US010054867B2

(12) United States Patent
Nishitera

(10) Patent No.: US 10,054,867 B2
(45) Date of Patent: Aug. 21, 2018

(54) TONER

(71) Applicant: KYOCERA Document Solutions Inc., Osaka (JP)

(72) Inventor: Haruhiro Nishitera, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/816,558

(22) Filed: Nov. 17, 2017

(65) Prior Publication Data

US 2018/0143555 A1 May 24, 2018

(30) Foreign Application Priority Data

Nov. 24, 2016 (JP) ..... 2016-227835

(51) Int. Cl.
*G03G 9/093* (2006.01)
*G03G 9/087* (2006.01)
*G03G 15/08* (2006.01)

(52) U.S. Cl.
CPC ..... *G03G 9/09371* (2013.01); *G03G 9/08755* (2013.01); *G03G 9/08793* (2013.01); *G03G 9/093* (2013.01); *G03G 9/09307* (2013.01); *G03G 15/08* (2013.01)

(58) Field of Classification Search
CPC ..... G03G 9/08755; G03G 9/093; G03G 9/09307; G03G 9/08793; G03G 9/09371; G03G 15/08
See application file for complete search history.

(56) References Cited

U.S. PATENT DOCUMENTS

2014/0255840 A1 9/2014 Sekiguchi et al.
2015/0118612 A1* 4/2015 Maetani ..... G03G 9/09328 430/109.1

FOREIGN PATENT DOCUMENTS

JP 2014-174262 A 9/2014

* cited by examiner

*Primary Examiner* — Thorl Chea
(74) *Attorney, Agent, or Firm* — Studebaker & Brackett PC

(57) ABSTRACT

A toner includes a plurality of toner particles each including a toner core and a shell layer covering a surface of the toner core. The toner core contains a crystalline polyester resin, a crosslinked non-crystalline polyester resin, and an uncross-linked non-crystalline polyester resin. An endothermic energy amount $\Delta H_{PES}$ is at least 0.0 mJ/mg and no greater than 1.0 mJ/mg. The shell layer contains a resin that has a repeating unit including an oxazoline group. The toner has a glass transition point of at least 10° C. and no greater than 40° C. Loss tangents tan $\delta_{60}$ and tan $\delta_{100}$ of the toner are each at least 1.00 and no greater than 4.00. Loss tangents tan $\delta_{160}$ and tan $\delta_{200}$ of the toner are each at least 0.01 and no greater than 0.50.

11 Claims, 2 Drawing Sheets

TONER

INCORPORATION BY REFERENCE

The present application claims priority under 35 U.S.C. § 119 to Japanese Patent Application No. 2016-227835, filed on Nov. 24, 2016. The contents of this application are incorporated herein by reference in their entirety.

BACKGROUND

The present disclosure relates to a toner.

In a toner, a loss tangent (=loss elastic modulus/storage elastic modulus) has at least an inflection point or a local maximal point at a temperature α within a range from 65° C. to 80° C. while having at least a local maximal point at a temperature β within a range from 75° C. to 90° C. The loss tangent at the temperature α is at least 1.2 and no greater than 2.0, the loss tangent at the temperature β is at least 1.0 and no greater than 2.5, and the temperatures α and β satisfy $\alpha<\beta$.

SUMMARY

A toner according to the present disclosure includes a plurality of toner particles. The toner particles each include a toner core and a shell layer covering a surface of the toner core. The toner core contains a crystalline polyester resin and non-crystalline polyester resins. The toner core contains, as the non-crystalline polyester resins, a crosslinked non-crystalline polyester resin and an uncrosslinked non-crystalline polyester resin. In differential scanning calorimetry of the toner, an endothermic energy amount due to melting of portions in which the crystalline polyester resin is crystallized is at least 0.0 mJ/mg and no greater than 1.0 mJ/mg. The shell layer contains a resin that has a repeating unit including an oxazoline group. The toner has a glass transition point of at least 10° C. and no greater than 40° C. A loss tangent of the toner at 60° C. is at least 1.00 and no greater than 4.00. A loss tangent of the toner at 100° C. is at least 1.00 and no greater than 4.00. A loss tangent of the toner at 160° C. is at least 0.01 and no greater than 0.50. A loss tangent of the toner at 200° C. is at least 0.01 and no greater than 0.50.

DETAILED DESCRIPTION

Figure 1:
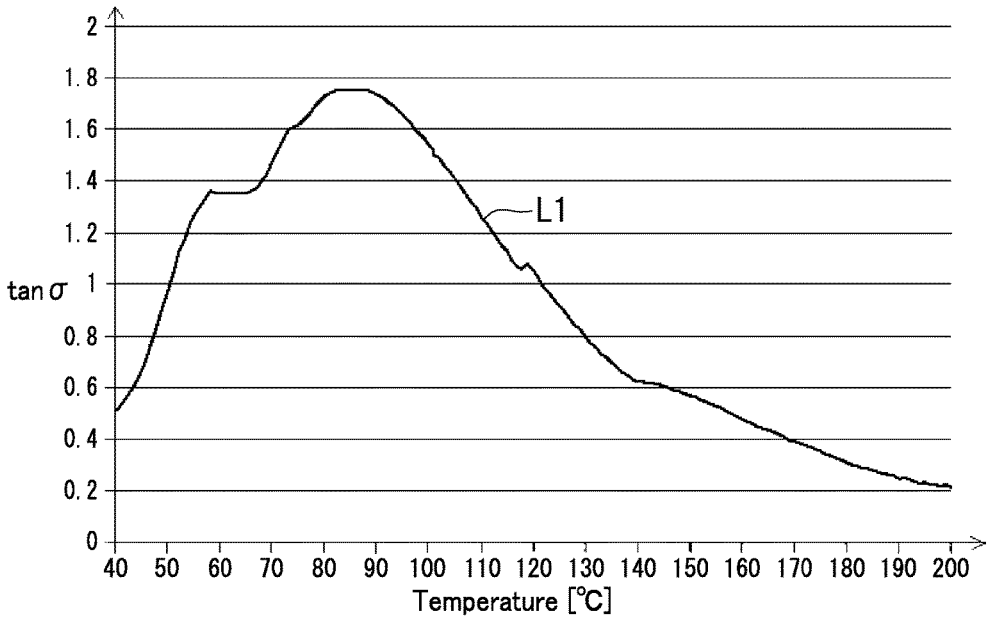
FIG. 1 is a graph illustrating a measurement example of the loss tangent.

The following describes an embodiment of the present disclosure. Unless otherwise stated, evaluation results (values indicating a shape, physical properties, and the like) for a powder (specific examples include toner mother particles, an external additive, and a toner) are each a number average of values measured for a suitable number of representative particles of the powder.

Unless otherwise stated, a number average particle diameter of a powder is a number average value of equivalent circle diameters (Heywood diameters: diameters of circles each having the same area as a projection of a particle) of primary particles measured using a microscope. Also, unless otherwise stated, a measured value for a volume median diameter ($D_{50}$) of a powder is a value measured using a laser diffraction/scattering particle size distribution analyzer ("LA-750" manufactured by Horiba, Ltd.). Also, unless otherwise stated, a measured value for a mass average molecular weight (Mw) is a value measured using gel permeation chromatography.

Unless otherwise stated, a glass transition point (Tg) is a value measured using a differential scanning calorimeter ("DSC-6220" manufactured by Seiko Instruments Inc.) in accordance with "Japanese Industrial Standard (JIS) K7121-2012". On a heat absorption curve (vertical axis: heat flow (DSC signal), horizontal axis: temperature) measured using the differential scanning calorimeter, a temperature (onset temperature) at an inflection point (intersection point of an extrapolation line of a base line and an extrapolation line of an inclined portion of the curve) corresponds to Tg (glass transition point). Also, unless otherwise stated, a softening point (Tm) is a value measured using a capillary rheometer ("CFT-500D" manufactured by Shimadzu Corporation). On an S-shaped curve (horizontal axis: temperature, vertical axis: stroke) measured using the capillary rheometer, a temperature at which a stroke value is "(base line stroke value+maximum stroke value)/2" corresponds to Tm (softening point). Also, unless otherwise stated, a measured value for a melting point (Mp) is a temperature at a peak indicating maximum heat absorption on a heat absorption curve (vertical axis: heat flow (DSC signal), horizontal axis: temperature) measured using the differential scanning calorimeter ("DSC-6220" manufactured by Seiko Instruments Inc.).

In the following description, the term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof. Furthermore, the term "(meth)acryl" is used as a generic term for both acryl and methacryl.

A toner according to the present embodiment can be suitably used for development of an electrostatic latent image for example as a positively chargeable toner. The toner according to the present embodiment is a powder including a plurality of toner particles (each having features described further below). The toner may be used as a one-component developer. Alternatively, the toner may be mixed with a carrier using a mixer (for example, a ball mill) to prepare a two-component developer. In order to form high-quality images, a ferrite carrier (powder of ferrite particles) is preferably used as the carrier. Also, in order to form high-quality images for an extended period of time, magnetic carrier particles each including a carrier core and a resin layer covering the carrier core are preferably used. Carrier cores may be formed from a magnetic material (for example, a ferromagnetic material such as ferrite) or a resin in which magnetic particles are dispersed in order to impart magnetism to the carrier particles. Also, magnetic particles may be dispersed in the resin layer covering the carrier core. In order to form high-quality images, an amount of the toner in the two-component developer is preferably at least 5 parts by mass and no greater than 15 parts by mass relative to 100 parts by mass of the carrier. Note that a positively chargeable toner included in a two-component developer is positively charged by friction with a carrier.

The toner according to the present embodiment can be used for image formation for example in an electrophotographic apparatus (image forming apparatus). The following describes an example of image formation methods using an electrophotographic apparatus.

First, an image forming section (a charger and a light exposure device) of the electrophotographic apparatus forms an electrostatic latent image on a photosensitive member (for example, a surface layer of a photosensitive drum) on the basis of image data. Subsequently, a developing device (specifically, a developing device loaded with a developer including the toner) of the electrophotographic apparatus supplies the toner to the photosensitive member to develop the electrostatic latent image formed on the photosensitive member. The toner is charged by friction with a carrier or a blade in the developing device before being supplied to the photosensitive member. For example, a positively chargeable toner is charged positively. In a development process, the toner (specifically, the charged toner) on a developing sleeve (for example, a surface layer of a development roller in the developing device) located adjacent to the photosensitive member is supplied to the photosensitive member. The supplied toner adheres to the electrostatic latent image on the photosensitive member, whereby a toner image is formed on the photosensitive member. The developing device is replenished with toner for replenishment use accommodated in a toner container in compensation for consumed toner.

In a subsequent transfer process, a transfer device of the electrophotographic apparatus transfers the toner image on the photosensitive member to an intermediate transfer member (for example, a transfer belt), and further transfers the toner image from the intermediate transfer member to a recording medium (for example, paper). Thereafter, a fixing device (fixing method: nip fixing using a heating roller and a pressure roller) of the electrophotographic apparatus fixes the toner to the recording medium through application of heat and pressure to the toner. Through the above, an image is formed on the recording medium. For example, a full-color image can be formed by superposing toner images in respective four colors: black, yellow, magenta, and cyan. After the transfer process, the toner remaining on the photosensitive member is removed by a cleaning member (for example, a cleaning blade). Note that the transfer process may be a direct transfer process by which the toner image on the photosensitive member is transferred directly to the recording medium not via the intermediate transfer member. Also, a belt fixing method may be employed as the fixing method.

The toner according to the present embodiment includes a plurality of toner particles. The toner particles may each include an external additive. In a configuration in which a toner particle includes an external additive, the toner particle includes a toner mother particle and the external additive. The external additive adheres to a surface of the toner mother particle. The toner mother particle contains a binder resin. The toner mother particle may contain an internal additive or internal additives (for example, at least one of a releasing agent, a colorant, a charge control agent, and a magnetic powder) other than the binder resin as necessary. Note that the external additive may be omitted if unnecessary. In a configuration in which the external additive is omitted, the toner mother particle is equivalent to the toner particle.

In the toner according to the present embodiment, the toner mother particle includes a toner core and a shell layer covering a surface of the toner core. The shell layer is substantially formed from a resin. For example, both heat-resistant preservability and low-temperature fixability of the toner can be achieved by covering a toner core that melts at low temperatures with a shell layer that is excellent in heat resistance. An additive may be dispersed in the resin forming the shell layer. Hereinafter, a material for forming the shell layer may be referred to as a shell material.

The toner according to the present embodiment is an electrostatic latent image developing toner having the following features (hereinafter referred to as basic features).

(Basic Features of Toner)

The toner includes a plurality of toner particles. The toner particles each include a toner core and a shell layer covering a surface of the toner core. The toner core contains a crystalline polyester resin and non-crystalline polyester resins. The toner core contains as the non-crystalline polyester resins, a crosslinked non-crystalline polyester resin and an uncrosslinked non-crystalline polyester resin. In differential scanning calorimetry of the toner, an endothermic energy amount (hereinafter may be referred to as an endothermic energy amount $\Delta H_{PES}$) due to melting of portions in which the crystalline polyester resin in the toner cores is crystallized is at least 0.0 mJ/mg and no greater than 1.0 mJ/mg. The shell layer contains a resin that has a repeating unit including an oxazoline group. The toner has a glass transition point of at least 10° C. and no greater than 40° C. A loss tangent (hereinafter may be referred to as loss tangent tan $\delta_{60}$) of the toner at 60° C. is at least 1.00 and no greater than 4.00. A loss tangent (hereinafter may be referred to as loss tangent tan $\delta_{100}$) of the toner at 100° C. is at least 1.00 and no greater than 4.00. A loss tangent (hereinafter may be referred to as loss tangent tan $\delta_{160}$) of the toner at 160° C. is at least 0.01 and no greater than 0.50. A loss tangent (hereinafter may be referred to as loss tangent tan $\delta_{200}$) of the toner at 200° C. is at least 0.01 and no greater than 0.50. The endothermic energy amount $\Delta H_{PES}$, glass transition point, and loss tangents tan $\delta_{60}$, tan $\delta_{100}$, tan $\delta_{160}$, and tan $\delta_{200}$ of the toner are measured by the same methods described further below or any alternative method thereof.

FIG. 1 is a graph (vertical axis: loss tangent, horizontal axis: temperature) indicating a relationship between the loss tangent (tan δ) and the temperature. FIG. 1 shows measurement results of an example of toners having the above-described basic features.

As indicated by a line L1 in FIG. 1, the toner has a loss tangent tan $\delta_{60}$ of at least 1.00 and no greater than 4.00 (specifically, approximately 1.37), a loss tangent tan $\delta_{100}$ of at least 1.00 and no greater than 4.00 (specifically, approximately 1.58), a loss tangent tan $\delta_{160}$ of at least 0.01 and no greater than 0.50 (specifically, approximately 0.48), and a loss tangent tan $\delta_{200}$ of at least 0.01 and no greater than 0.50 (specifically, approximately 0.22).

Figure 2:
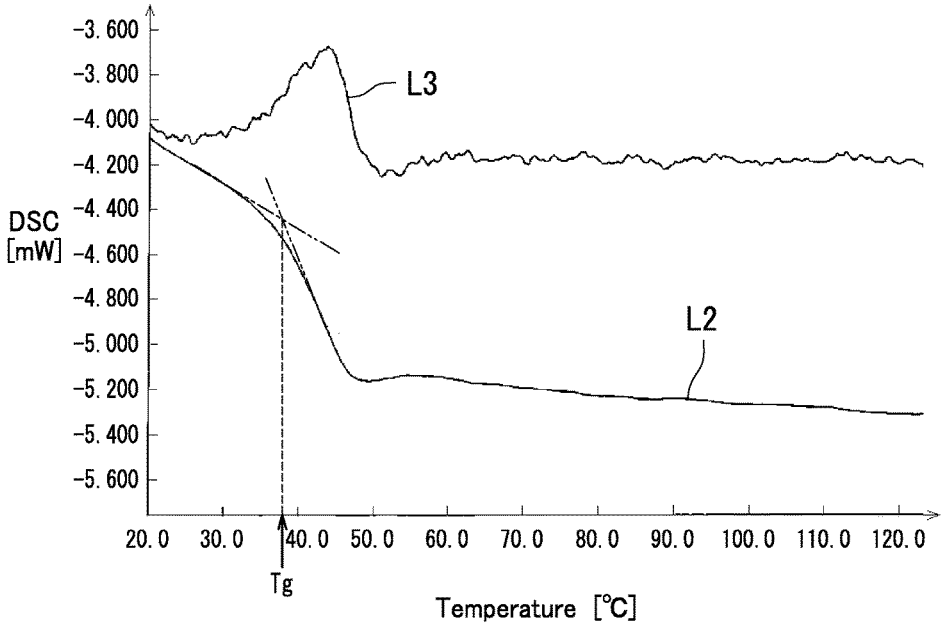
FIG. 2 is a graph illustrating a measurement example of a differential scanning calorimetry spectrum.

FIG. 2 is a graph indicating DSC data measured using a differential scanning calorimeter at a heating rate of 10° C./minute. FIG. 2 shows measurement results of an example of toners having the above-described basic features. A line L2 in FIG. 2 indicates a heat absorption curve (vertical axis: heat flow (DSC signal), horizontal axis: temperature). A line L3 in FIG. 2 indicates a differential curve (DDSC) of the heat absorption curve (differential scanning calorimetry spectrum) indicated by the line L2. The vertical axis has scale marks corresponding to the line L2 (heat absorption curve). Scale marks corresponding to the line L3 (DDSC) are omitted.

As shown in FIG. 2, a glass transition point (Tg) of the toner can be read from the line L2. Specifically, a temperature at an inflection point (intersection point of an extrapolation line of a base line of the line L2 and an extrapolation line of an inclined portion of the line L2) due to glass transition of the toner corresponds to the glass transition point (Tg) of the toner. The glass transition point (Tg) of the toner read from the line L2 in FIG. 2 is 37.8° C.

Also, no heat absorption peak derived from portions in which the crystalline polyester resin is crystallized (specifically, heat absorption peak generated as a result of melting of portions in which the crystalline polyester resin is crystallized) can be observed in the line L2 (differential scanning calorimetry spectrum). Therefore, an endothermic energy amount $\Delta H_{PES}$ (endothermic energy amount due to melting of portions in which the crystalline polyester resin in the toner cores is crystallized) of the toner is 0.0 mJ/mg. In a situation in which the line L2 (differential scanning calorimetry spectrum) has the above-described heat absorption peak, an endothermic energy amount $\Delta H_{PES}$ can be determined from an area of the heat absorption peak. Note that the crystalline polyester resin tends not to crystallize during heating when the differential scanning calorimetry spectrum is measured at a heating rate (specifically, 10° C./minute) that is sufficiently high relative to a time necessary for crystallization of the crystalline polyester resin. Also, the above-described heat absorption peak is observed around a melting point (Mp) of the crystalline polyester resin.

The present inventor found that a toner that is viscous in a low temperature fixing range (specifically, temperature range from 60° C. to 100° C.) and elastic in a high temperature fixing range (specifically, temperature range from 160° C. to 200° C.) is excellent in both low-temperature fixability and hot offset resistance. A resin having a larger loss tangent tends to exhibit higher viscosity, and a resin having a smaller loss tangent tends to exhibit higher elasticity. The loss tangents tan $\delta_{60}$ and tan $\delta_{100}$ of the toner having the above-described basic features are each at least 1.00 and no greater than 4.00, and the toner has high viscosity in the low temperature fixing range (specifically, temperature range from 60° C. to 100° C.). Therefore, the toner can be surely fixed to the recording medium even at low temperatures. Also, the loss tangents tan $\delta_{160}$ and tan $\delta_{200}$ of the toner having the above-described basic features are each at least 0.01 and no greater than 0.50, and the toner has high elasticity in the high temperature fixing range (specifically, temperature range from 160° C. to 200° C.). Therefore, it can be ensured that the toner has sufficient releasability with respect to the fixing roller, and hot offset (phenomenon in which melted toner adheres to the fixing roller in the case of fixing the toner at a high temperature) tends not to occur. The toner having the above-described basic features has excellent fixability in both the low temperature fixing range and the high temperature fixing range, and therefore can be appropriately fixed to the recording medium over a wide temperature range.

In the above-described basic features, the loss tangents tan $\delta_{60}$ and tan $\delta_{100}$ of the toner are each no greater than 4.00. Therefore, the toner having the above-described basic features has excellent heat-resistant preservability. When viscosity of the toner is excessively high before the fixing (i.e., while being preserved or conveyed), the toner tends to agglomerate, and heat-resistant preservability of the toner deteriorates.

The present inventor confirmed through experiments that when a temperature of the toner is gradually increased by heating the toner, viscosity of the toner tends to gradually increase along with the increase in the temperature of the toner, and that when the temperature of the toner comes near the glass transition point of the toner, the viscosity of the toner tends to sharply increase (an amount of change of the viscosity along with the temperature increase becomes large). In order that the toner is viscous in the low temperature fixing range (specifically, temperature range from 60° C. to 100° C.), the glass transition point of the toner is preferably low. In the above-described basic features, the glass transition point of the toner is at least 10° C. and no greater than 40° C. In a configuration in which the toner has a sufficiently low glass transition point, the toner tends to have high viscosity in the low temperature fixing range.

In the above-described basic features, the glass transition point of the toner is at least 10° C. Therefore, the toner having the above-described basic features has excellent heat-resistant preservability. When the glass transition point of the toner is excessively low, the toner tends to agglomerate before the fixing (i.e., while being preserved or conveyed), and heat-resistant preservability of the toner deteriorates. In order to ensure sufficient heat-resistant preservability of the toner, the glass transition point of the toner is preferably at least 25° C.

The present inventor found that when the crystalline polyester resin that is not crystallized is compatibilized with the non-crystalline polyester resins in the toner core, the crystalline polyester resin serves as a plasticizer and the glass transition point (Tg) of the toner decreases. By contrast, when the crystalline polyester resin is crystallized, the crystalline polyester resin becomes hard and tends to be difficult to compatibilize with the non-crystalline polyester resins. When the toner core is produced by mixing the crystallized crystalline polyester resin with the non-crystalline polyester resins, the glass transition point (Tg) of the toner tends not to decrease.

As the endothermic energy amount $\Delta H_{PES}$ of the toner in the above-described basic features is small, the toner core tends to contain a larger amount of the crystalline polyester resin that is not crystallized. In the toner having the above-described basic features, the endothermic energy amount $\Delta H_{PES}$ (endothermic energy amount due to melting of the portions in which the crystalline polyester resin is crystallized, which amount is determined by differential scanning calorimetry of the toner) is at least 0.0 mJ/mg and no greater than 1.0 mJ/mg. Therefore, the toner tends to have a sufficiently low glass transition point (specifically, at least 10° C. and no greater than 40° C.).

In the above-described basic features, the endothermic energy amount $\Delta H_{PES}$ can be determined from an area of a heat absorption peak in a differential scanning calorimetry spectrum. Note that the non-crystalline polyester resins do not crystallize. Therefore, in a configuration in which the toner core contains the non-crystalline polyester resins only, the differential scanning calorimetry spectrum of the toner does not have a heat absorption peak due to melting of crystallized portions of the polyester resins, and the endothermic energy amount $\Delta H_{PES}$ of the toner is 0.0 mJ/mg.

As described above, a toner having a sufficiently low glass transition point (Tg) tends to have high viscosity in the low temperature fixing range. However, a toner that maintains high viscosity even in the high temperature fixing range tends to have poor hot offset resistance. In the toner having the above-described basic features, the toner core contains the crosslinked non-crystalline polyester resin and the uncrosslinked non-crystalline polyester resin. Due to the presence of the crosslinked polyester resin as well as the uncrosslinked polyester resin in the toner core, the toner that has become viscous by heating tends to become elastic again (i.e., restore a state before the heating) by further heating. Therefore, the toner tends to have high elasticity in the high temperature fixing range (specifically, temperature range from 160° C. to 200° C.). Note that in a configuration in which the toner core contains the crosslinked non-crystalline polyester resin only as the non-crystalline polyester resin, it is difficult to ensure sufficient low-temperature fixability of the toner (see a toner TB-8 described further below).

In order that the toner has both heat-resistant preservability and low-temperature fixability, the surface of the toner core is preferably covered with the shell layer. However, a toner core that contains a crosslinked resin tends to be hard. When the shell layer is formed on a surface of such a toner core, bonding between the toner core and the shell layer tends to be weak. In order to form the shell layer appropriately on the surface of the toner core that contains the crystalline polyester resin, the crosslinked non-crystalline polyester resin, and the uncrosslinked non-crystalline polyester resin, the shell layer preferably contains a resin that has a repeating unit including an oxazoline group. Particularly preferably, the shell layer contains a copolymer of at least two vinyl compounds including a compound represented by formula (1) shown below.

(1)

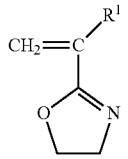

In the above formula (1), $R^1$ represents a hydrogen atom or an optionally substituted alkyl group (which may be linear, branched, or cyclic). $R^1$ particularly preferably represents a hydrogen atom or a methyl group. For example, in the case of 2-vinyl-2-oxazoline, $R^1$ in formula (1) represents a hydrogen atom.

It is thought that in a polymer of a vinyl compound, a repeating unit derived from the vinyl compound is addition polymerized through carbon-to-carbon double bonds "C═C" ("C═C"→"—C—C—"). The vinyl compound is a compound that has a vinyl group ($CH_2$═CH—) or a substituted vinyl group in which hydrogen is replaced. Examples of vinyl compounds include ethylene, propylene, butadiene, vinyl chloride, acrylic acid, acrylic acid esters, methacrylic acid, methacrylic acid esters, acrylonitrile, and styrene, as well as the compound represented by the above formula (1).

The compound represented by the above formula (1) forms a repeating unit (hereinafter referred to as a repeating unit (1-1)) represented by formula (1-1) shown below through addition polymerization. In formula (1-1), $R^1$ represents the same group as $R^1$ in formula (1). The repeating unit (1-1) is derived from a vinyl compound that has an oxazoline group (crosslinkable functional group). As a material for forming the resin that has a repeating unit including the oxazoline group, for example, an aqueous solution of an oxazoline group-containing polymer ("EPOCROS (registered Japanese trademark) WS series" manufactured by Nippon Shokubai Co., Ltd.) can be used. Specifically, "EPOCROS WS-300" contains a copolymer of 2-vinyl-2-oxazoline and methyl methacrylate. Also, "EPOCROS WS-700" contains a copolymer of 2-vinyl-2-oxazoline, methyl methacrylate, and butyl acrylate.

(1-1)

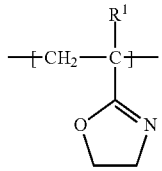

The repeating unit (1-1) includes a ring unopened oxazoline group. The ring unopened oxazoline group has cyclic structure and exhibits strong positive chargeability. The ring unopened oxazoline group readily reacts with a carboxyl group, an aromatic sulfanyl group, and an aromatic hydroxyl group. For example, when the repeating unit (1-1) in the shell layer reacts with a carboxyl group (represented by $R^0$ in formula (1-2) shown below) of a polyester resin in the toner core, the ring of the oxazoline group is opened as indicated in formula (1-2), and an amide ester bond is formed between the toner core and the shell layer. As a result of formation of this bond, bonding between the toner core and the shell layer becomes strong and separation of the shell layer from the toner core is inhibited.

(1-2)

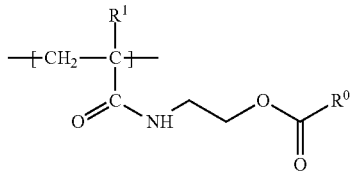

The resin that is contained in the shell layer and that has a repeating unit including the oxazoline group is particularly preferably a polymer of at least one compound represented by formula (1) and at least one acrylic acid-based monomer.

In order that the toner maintains excellent positive chargeability over a long period of time, an amount (hereinafter may be referred to as a ring unopened oxazoline group content) of the ring unopened oxazoline group contained in 1 g of the toner, which amount is measured by gas chromatography-mass spectrometry, is preferably at least 30 μmol/g and no greater than 770 μmol/g. In a configuration in which the ring unopened oxazoline group content of the toner is excessively small or excessively large, positive chargeability of the toner tends to be excessively weak or excessively strong when the toner is used in continuous printing. The ring unopened oxazoline group content can be controlled by adjusting a ring-opening rate of the oxazoline group contained in the shell layer and a thickness of the shell layer. The ring-opening rate of the oxazoline group can be controlled for example by adjusting an amount of addition of a ring opening agent.

The toner core preferably does not contain the oxazoline group. In a configuration in which the oxazoline group is present only on the surface of the toner core (i.e., in the shell layer) and is not present inside the toner core, the toner tends to be excellent in fixability, chargeability, and heat-resistant preservability.

In order that the toner has the above-described basic features, the toner cores are preferably pulverized cores (so called pulverized toner). The pulverized cores are toner cores produced by a pulverization method (one of dry methods). The pulverization method is a method for obtaining a powder (for example, the toner cores) through melt kneading of a plurality of materials (a resin and the like) to obtain a kneaded product and pulverization of the resultant kneaded product. Note that the pulverized cores are typically distinguished from polymerized cores (so called chemical toner), and can be easily identified from the shape of particles or surface conditions of the particles. The pulverized cores are produced by the pulverization method (dry method), while the polymerized cores are produced by a wet method. Due to this difference in production method, the pulverized cores are typically more excellent in environment friendliness than the polymerized cores.

In order to obtain a toner that is excellent in heat-resistant preservability, low-temperature fixability, and positive chargeability, the shell layer preferably has a thickness of at least 1 nm and no greater than 20 nm. The thickness of the shell layer can be measured through analysis of a transmission electron microscope (TEM) image of a cross section of a toner particle using a commercially available image analysis software (for example, "WinROOF" manufactured by Mitani Corporation). Note that in a situation in which the shell layer of a toner particle does not have a uniform thickness, thicknesses of the shell layer are measured at four positions equally spaced apart from each other (specifically, four positions at which the shell layer intersects with two orthogonal straight lines intersecting with each other at substantially the center of a cross section of the toner particle), and an arithmetic mean of the thus measured four values is determined to be an evaluation value (the thickness of the shell layer) of the toner particle. A boundary between the toner core and the shell layer can be observed for example by selectively dying only the shell layer excluding the toner core. In a situation in which the boundary between the toner core and the shell layer in the TEM image is unclear, the boundary between the toner core and the shell layer can be clarified by mapping characteristic elements contained in the shell layer in the TEM image using a combination of TEM and electron energy loss spectroscopy (EELS).

An entire surface area of the toner core may be completely covered by the shell layer. Alternatively, the surface of the toner core may be partially covered by the shell layer and include a region (hereinafter referred to as a covered region) that is covered by the shell layer and a region (hereinafter referred to as an exposed region) that is not covered by the shell layer. However, in order to obtain a toner that is excellent in heat-resistant preservability, low-temperature fixability, and positive chargeability, the shell layer preferably covers from 95% to 100% of the surface of the toner core. That is, shell coverage is preferably from 95% to 100%. The shell coverage is expressed as "shell coverage (unit: %)=100×(area covered by shell layer)/(surface area of toner core)". Shell coverage of 100% indicates that the entire surface area of the toner core is covered by the shell layer. The shell coverage can be measured for example through analysis of an image of a toner particle (toner particle dyed in advance) taken using a field emission scanning electron microscope ("JSM-7600F" manufactured by JEOL Ltd.). The covered region of the surface of the toner core can be distinguished from the other region (uncovered region) for example by a difference in brightness value.

In order to obtain a toner that is suitable for image formation, the toner cores preferably have a volume median diameter ($D_{50}$) of at least 4 μm and no greater than 9 μm.

Next, the following describes the toner core (a binder resin and internal additives), the shell layer, and the external additive in order. Nonessential components may be omitted depending on an intended use of the toner.

[Toner Core]

(Binder Resin)

The binder resin is typically a main component (for example, at least 85% by mass) of the toner core. Therefore, properties of the binder resin are thought to have great influence on properties of the toner core as a whole. The properties (specifically, a hydroxyl value, an acid value, Tg, Tm, and the like) of the binder resin can be adjusted by using a plurality of resins in combination as the binder resin. The toner core has a strong tendency to be anionic in a configuration in which the binder resin has an ester group, a hydroxyl group, an ether group, an acid group, or a methyl group. By contrast, the toner core has a strong tendency to be cationic in a configuration in which the binder resin has an amino group.

In the toner having the above-described basic features, the toner core contains the crystalline polyester resin, the crosslinked non-crystalline polyester resin, and the uncrosslinked non-crystalline polyester resin.

The crosslinked non-crystalline polyester resin is a non-crystalline polyester resin that is crosslinked. A cross-linking agent for crosslinking the non-crystalline polyester resin is preferably a tri- or higher hydric alcohol or a tri- or higher basic carboxylic acid, and particularly preferably a tribasic carboxylic acid.

In order that the toner has both heat-resistant preservability and low-temperature fixability, the toner core contains preferably a crystalline polyester resin that has a melting point of at least 60° C. and no greater than 90° C., and particularly preferably a crystalline polyester resin that has a melting point of at least 65° C. and no greater than 80° C.

In order that the toner core has a desired degree of sharp meltability, the toner core preferably contains a crystalline polyester resin that has a crystallinity index of at least 0.90 and no greater than 1.15. The crystallinity index of a resin corresponds to a ratio (=Tm/Mp) of a softening point (Tm) of the resin to a melting point (Mp) of the resin. Definite Mp of a non-crystalline polyester resin is often unmeasurable. The crystallinity index of the crystalline polyester resin can be adjusted by changing materials (for example, an alcohol and/or a carboxylic acid) for synthesizing the crystalline polyester resin or amounts of use (blend ratio) of the materials. The toner core may contain only one crystalline polyester resin or two or more crystalline polyester resins.

A polyester resin can be obtained through condensation polymerization of at least one polyhydric alcohol (specific examples include aliphatic diols, bisphenols, and tri- or higher hydric alcohols listed below) and at least one polybasic carboxylic acid (specific examples include dibasic carboxylic acids and tri- or higher basic carboxylic acids listed below). Also, the polyester resin may have a repeating unit derived from other monomers (monomers that are neither polyhydric alcohols nor polybasic carboxylic acids: specific examples include styrene-based monomers and acrylic acid-based monomers listed below).

Preferable examples of aliphatic diols include diethylene glycol, triethylene glycol, neopentyl glycol, 1,2-propanediol, α,ω-alkanediols (specific examples include ethylene glycol, 1,3-propanediol, 1,4-butanediol, 1,5-pentanediol, 1,6-hexanediol, 1,7-heptanediol, 1,8-octanediol, 1,9-nonanediol, and 1,12-dodecanediol), 2-buten-1,4-diol, 1,4-cyclohexanedimethanol, dipropylene glycol, polyethylene glycol, polypropylene glycol, and polytetramethylene glycol.

Preferable examples of bisphenols include bisphenol A, hydrogenated bisphenol A, bisphenol A ethylene oxide adducts, and bisphenol A propylene oxide adducts.

Preferable examples of tri- or higher hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Preferable examples of dibasic carboxylic acids include aromatic dicarboxylic acids (specific examples include phthalic acid, terephthalic acid, and isophthalic acid), α,ω-alkane dicarboxylic acids (specific examples include malonic acid, succinic acid, adipic acid, suberic acid, azelaic acid, sebacic acid, and 1,10-decanedicarboxylic acid), alkyl succinic acids (specific examples include n-butylsuccinic acid, isobutylsuccinic acid, n-octylsuccinic acid, n-dodecylsuccinic acid, and isododecylsuccinic acid), alkenylsuccinic acids (specific examples include n-butenylsuccinic acid, isobutenylsuccinic acid, n-octenylsuccinic acid, n-dodecenylsuccinic acid, and isododecenylsuccinic acid), unsaturated dicarboxylic acids (specific examples include maleic acid, fumaric acid, citraconic acid, itaconic acid, and glutaconic acid), and cycloalkanedicarboxylic acids (specific examples include cyclohexanedicarboxylic acid).

Preferable examples of tri- or higher basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

Preferable examples of styrene-based monomers include styrene, alkylstyrenes (specific examples include α-methylstyrene, p-ethylstyrene, and 4-tert-butylstyrene), hydroxystyrenes (specific examples include p-hydroxystyrene and m-hydroxystyrene), and halogenated styrenes (specific examples include α-chlorostyrene, o-chlorostyrene, m-chlorostyrene, and p-chlorostyrene).

Preferable examples of acrylic acid-based monomers include (meth)acrylic acid, (meth)acrylonitrile, (meth) acrylic acid alkyl esters, and (meth)acrylic acid hydroxyalkyl esters. Preferable examples of (meth)acrylic acid alkyl esters include methyl (meth)acrylate, ethyl (meth)acrylate, n-propyl (meth)acrylate, iso-propyl (meth)acrylate, n-butyl (meth)acrylate, iso-butyl (meth)acrylate, and 2-ethylhexyl (meth)acrylate. Preferable examples of (meth)acrylic acid hydroxyalkyl esters include 2-hydroxyethyl (meth)acrylate, 3-hydroxypropyl (meth)acrylate, 2-hydroxypropyl (meth) acrylate, and 4-hydroxybutyl (meth)acrylate.

Preferable examples of the crystalline polyester resin contained in the toner core include a polymer (hereinafter may be referred to as a preferable crystalline polyester resin) of monomers (resin raw materials) including at least one α,ω-alkanediol that has a carbon number of at least 1 and no greater than 8 (specific examples include ethylene glycol that has a carbon number of 2), at least one α,ω-alkane dicarboxylic acid that has a carbon number of at least 6 and no greater than 14 (specific examples include sebacic acid that has a carbon number of 10), at least one styrene-based monomer (specific examples include styrene), and at least one acrylic acid-based monomer (specific examples include butyl methacrylate). Note that the carbon number of α,ω-alkane dicarboxylic acid is the number of carbon atoms including the carbon atom in the carboxyl group.

In a preferable example of the toner, the toner core contains a crosslinked non-crystalline polyester resin and an uncrosslinked non-crystalline polyester resin described below together with the preferable crystalline polyester resin described above. Specifically, in the preferable example of the toner, the crosslinked non-crystalline polyester resin is a polymer of monomers (resin raw materials) including at least one bisphenol (specific examples include bisphenol A ethylene oxide adducts), at least one aromatic dicarboxylic acid (specific examples include terephthalic acid), and at least one tribasic carboxylic acid (specific examples include trimellitic acid), and the uncrosslinked non-crystalline polyester resin is a polymer of monomers (resin raw materials) including at least one bisphenol (specific examples include bisphenol A propylene oxide adducts) and at least one α,ω-alkane dicarboxylic acid that has a carbon number of at least 4 and no greater than 10 (specific examples include adipic acid that has a carbon number of 6).

In the above-described preferable example of the toner, the uncrosslinked non-crystalline polyester resin is particularly preferably a polymer of monomers (resin raw materials) including at least two bisphenols (for example, two bisphenols: bisphenol A ethylene oxide adduct and bisphenol A propylene oxide adduct), at least one aromatic dicarboxylic acid (specific examples include terephthalic acid), and at least one α,ω-alkane dicarboxylic acid that has a carbon number of at least 4 and no greater than 10 (specific examples include adipic acid that has a carbon number of 6).

In the above-described preferable example of the toner, an amount of the crystalline polyester resin in the toner cores is preferably at least 10 parts by mass and no greater than 25 parts by mass relative to 100 parts by mass of the non-crystalline polyester resins in the toner cores, and an amount of the uncrosslinked non-crystalline polyester resin in the toner cores is preferably at least 0.3 times and no greater than 3.0 times an amount of the crosslinked non-crystalline polyester resin in the toner cores. Note that the tribasic carboxylic acid serves as a cross-linking agent in the cross-linked non-crystalline polyester resin.

(Colorant)

The toner core may contain a colorant. A known pigment or dye that matches the color of the toner may be used as the colorant. In order to obtain a toner that is suitable for image formation, an amount of the colorant is preferably at least 1 part by mass and no greater than 20 parts by mass relative to 100 parts by mass of the binder resin.

The toner core may contain a black colorant. Examples of black colorants include carbon black. Alternatively, the black colorant may be a colorant adjusted to a black color using a yellow colorant, a magenta colorant, and a cyan colorant.

The toner core may contain a non-black colorant such as a yellow colorant, a magenta colorant, or a cyan colorant.

As the yellow colorant, at least one compound selected from the group consisting of condensed azo compounds, isoindolinone compounds, anthraquinone compounds, azo metal complexes, methine compounds, and arylamide compounds can for example be used. Specific examples of yellow colorants that can be preferably used include C. I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G, and C. I. Vat Yellow.

As the magenta colorant, at least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds can for example be used. Specific examples of magenta colorants that can be preferably used include C. I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

As the cyan colorant, at least one compound selected from the group consisting of copper phthalocyanine compounds, anthraquinone compounds, and basic dye lake compounds can for example be used. Specific examples of cyan colorants that can be preferably used include C.I. Pigment Blue (1, 7, 15, 15:1, 15:2, 15:3, 15:4, 60, 62, and 66), Phthalocyanine Blue, C.I. Vat Blue, and C.I. Acid Blue.

(Releasing Agent)

The toner core may contain a releasing agent. The releasing agent is used for example in order to improve fixability or offset resistance of the toner. In order to improve fixability or offset resistance of the toner, an amount of the releasing agent is preferably at least 1 part by mass and no greater than 30 parts by mass relative to 100 parts by mass of the binder resin.

Examples of releasing agents that can be preferably used include: aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax and block copolymer of polyethylene oxide wax; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes having a fatty acid ester as a main component such as montanic acid ester wax and castor wax; and waxes in which a part or all of a fatty acid ester has been deoxidized such as deoxidized carnauba wax. A releasing agent may be used alone, or a plurality of releasing agents may be used in combination.

(Charge Control Agent)

The toner core may contain a charge control agent. The charge control agent is used for example in order to improve charge stability or a charge rise characteristic of the toner. The charge rise characteristic of the toner is an indicator as to whether or not the toner is chargeable to a specific charge level in a short time.

Anionicity of the toner core can be made strong by inclusion of a negatively chargeable charge control agent (specific examples include organic metal complexes and chelate compounds) in the toner core. Also, cationicity of the toner core can be made strong by inclusion of a positively chargeable charge control agent (specific examples include pyridine, nigrosine, and quaternary ammonium salts) in the toner core. However, in a situation in which sufficient chargeability of the toner is ensured, the toner core need not contain the charge control agent.

(Magnetic Powder)

The toner core may contain a magnetic powder. Examples of materials of the magnetic powder that can be preferably used include ferromagnetic metals (specific examples include iron, cobalt, nickel, and alloys including at least one of these metals), ferromagnetic metal oxides (specific examples include ferrite, magnetite, and chromium dioxide), and materials subjected to ferromagnetization (specific examples include carbon materials to which ferromagnetism is imparted through thermal treatment). A magnetic powder may be used alone, or a plurality of magnetic powders may be used in combination.

[Shell Layer]

In the toner having the above-described basic features, the shell layer contains a resin that has a repeating unit including an oxazoline group. The shell layer preferably contains a copolymer of at least two vinyl compounds including a compound represented by the above formula (1). Also, the copolymer of at least two vinyl compounds including the compound represented by formula (1) preferably has a repeating unit derived from a vinyl compound (hereinafter referred to as the other vinyl compound) other than the compound represented by formula (1).

The other vinyl compound is preferably at least one vinyl compound selected from the group consisting of acrylic acid alkyl esters having an optionally substituted alkyl group, methacrylic acid alkyl esters having an optionally substituted alkyl group, and styrene-based monomers.

For example, in a configuration in which the other vinyl compound is an acrylic acid alkyl ester having an optionally substituted alkyl group, the acrylic acid alkyl ester becomes a repeating unit for example represented by the following formula (2) through addition polymerization to constitute the copolymer.

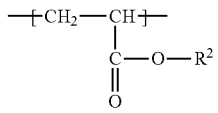

(2)

In formula (2), $R^2$ represents an optionally substituted alkyl group (which may be linear, branched, or cyclic). The alkyl group preferably has a carbon number of at least 1 and no greater than 8. In a configuration in which $R^2$ represents a substituted alkyl group, the substituent of the alkyl group is preferably a hydroxyl group. $R^2$ preferably represents a methyl group, an ethyl group, an n-propyl group, an iso-propyl group, an n-butyl group, an iso-butyl group, a 2-ethylhexyl group, a hydroxyethyl group, a hydroxypropyl group, or hydroxybutyl group.

For example, in a configuration in which the other vinyl compound is a methacrylic acid alkyl ester having an optionally substituted alkyl group, the methacrylic acid alkyl ester becomes a repeating unit for example represented by the following formula (3) through addition polymerization to constitute the copolymer.

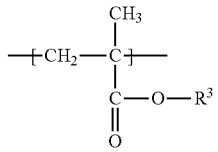

(3)

In formula (3), $R^3$ represents an optionally substituted alkyl group (which may be linear, branched, or cyclic). The alkyl group preferably has a carbon number of at least 1 and no greater than 8. In a configuration in which $R^3$ represents a substituted alkyl group, the substituent of the alkyl group is preferably a hydroxyl group. $R^3$ preferably represents a methyl group, an ethyl group, an n-propyl group, an iso-propyl group, an n-butyl group, an iso-butyl group, a 2-ethylhexyl group, a hydroxyethyl group, a hydroxypropyl group, or a hydroxybutyl group.

For example, in a configuration in which the other vinyl compound is a styrene-based monomer, the styrene-based monomer becomes a repeating unit for example represented by the following formula (4) through addition polymerization to constitute the copolymer.

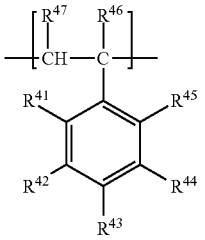

(4)

In formula (4), $R^{41}$ to $R^{47}$ each represent, independently of one another, a hydrogen atom or a functional group. $R^{41}$ to $R^{45}$ each preferably represent, independently of one another, a halogen atom, a hydroxyl group, an optionally substituted alkyl group, or an optionally substituted aryl group, and particularly preferably represent, independently of one another, a halogen atom, a methyl group, an ethyl group, or a hydroxyl group. $R^{46}$ and $R^{47}$ each preferably represent, independently of one another, a hydrogen atom or a methyl group.

[External Additive]

An external additive (specifically, a powder including a plurality of external additive particles) may be caused to adhere to surfaces of the toner mother particles. Unlike internal additives, the external additive is not present inside the toner mother particles and is selectively present only on the surfaces of the toner mother particles (i.e., in surface layers of the toner particles). The external additive particles can be caused to adhere to the surface of each toner mother particle for example by stirring the toner mother particles (powder) and the external additive (powder) together. The toner mother particle does not chemically react with the external additive particles. The toner mother particle and the external additive particles are bonded together physically rather than chemically. Bonding strength between the toner mother particle and the external additive particles can be adjusted by changing stirring conditions (specific examples include a stirring time and a rotational speed of stirring) and a particle diameter, a shape, and surface conditions of the external additive particles.

The external additive particles are preferably inorganic particles, and particularly preferably silica particles or particles of metal oxides (specific examples include alumina, titanium oxide, magnesium oxide, zinc oxide, strontium titanate, and barium titanate). However, resin particles or particles of organic acid compounds such as fatty acid metal salts (specific examples include zinc stearate) may be used as the external additive particles. Also, composite particles that are a composite of a plurality of materials may be used as the external additive particles. The external additive particles may be subjected to surface treatment. A single type of external additive particles may be used alone or plural types of external additive particles may be used in combination.

In order to make the external additive to sufficiently exhibit its function while preventing separation of the external additive particles from the toner particles, an amount of the external additive (in a situation in which plural types of external additive particles are used, a total amount of the external additive particles) is preferably at least 0.5 parts by mass and no greater than 10 parts by mass relative to 100 parts by mass of the toner mother particles.

In order to improve fluidity of the toner, it is preferable to use as the external additive particles, inorganic particles (powder) having a number average primary particle diameter of at least 5 nm and no greater than 30 nm. In order to make the external additive to function as a spacer among the toner particles to improve heat-resistant preservability of the toner, it is preferable to use as the external additive particles, resin particles (powder) having a number average primary particle diameter of at least 50 nm and no greater than 200 nm.

[Method for Producing Toner]

The following describes an example of methods for producing the toner having the above-described basic features. First, toner cores are prepared. Subsequently, the toner cores and a shell material (for example, an aqueous solution of an oxazoline group-containing water-soluble polymer) are added to a liquid. Subsequently, reaction of the shell material is caused in the liquid to form the shell layer substantially formed from a resin on the surface of each toner core. In order to adjust a ring unopened oxazoline group content in the toner to a desired value, the shell layer is preferably formed on the surface of each toner core in a liquid that contains a basic substance (specific examples include ammonia and sodium hydroxide) and/or a ring opening agent (specific examples include acetic acid). The ring unopened oxazoline group content in the toner can be adjusted by changing amounts of the basic substance and the ring opening agent. An increase in the amount of the basic substance in the liquid tends to result in an increase in the ring unopened oxazoline group content. Neutralization (trapping) of the carboxylic acid by the basic substance is thought to inhibit ring-opening reaction of the oxazoline group (nucleophilic addition reaction toward the carbonyl group). By contrast, an increase in the amount of the ring opening agent in the liquid tends to results in a reduction in the ring unopened oxazoline group content, since the ring opening agents promotes the ring-opening reaction of the oxazoline group.

In order to form the shell layer uniformly, the shell material is preferably dissolved or dispersed in the liquid for example by stirring the liquid containing the shell material. Also, in order to inhibit dissolution or elution of toner core components (particularly, the binder resin and the releasing agent) during formation of the shell layer, the shell layer is preferably formed in an aqueous medium. The aqueous medium is a medium (specific examples include pure water and a liquid mixture of water and a polar medium) in which water is a main component. The aqueous medium may function as a solvent. A solute may be dissolved in the aqueous medium. The aqueous medium may function as a dispersion medium. A dispersoid may be dispersed in the aqueous medium. An alcohol (specific examples include methanol and ethanol) can for example be used as the polar medium in the aqueous medium. The aqueous medium has a boiling point of approximately 100° C.

The following further describes a more specific example of the methods for producing the toner.

(Preparation of Toner Cores)

In order to easily obtain preferable toner cores, the toner cores are preferably produced by an aggregation method or a pulverization method, and more preferably produced by the pulverization method.

The following describes an example of the pulverization method. Initially, the binder resin and the internal additive(s) (for example, at least one of the colorant, the releasing agent, the charge control agent, and the magnetic powder) are mixed. Subsequently, the resultant mixture is melt-kneaded. Subsequently, the resultant melt-kneaded product is pulverized, and the resultant pulverized product is classified. Through the above, toner cores having a desired particle diameter are obtained.

The following describes an example of the aggregation method. Initially, the binder resin, the releasing agent, and the colorant each in the form of particulates are caused to aggregate in an aqueous medium to obtain aggregated particles containing components of the binder resin, the releasing agent, and the colorant. Subsequently, the resultant aggregated particles are heated to cause coalescence of the components contained in the aggregated particles. Through the above, a dispersion of toner cores is obtained. Thereafter, unnecessary substances (surfactant and the like) are removed from the dispersion of the toner cores to obtain the toner cores.

(Formation of Shell Layer)

Subsequently, the toner cores and a shell material (for example, an aqueous solution of an oxazoline group-containing polymer) are added to an aqueous medium (for example, ion exchanged water).

The shell material (for example, the oxazoline group-containing polymer dissolved in the aqueous medium) adheres to the surface of each toner core in the liquid. In order that the shell material uniformly adheres to the surface of each toner core, it is preferable to achieve a high degree of dispersion of the toner cores in the liquid containing the shell material. In order to achieve the high degree of dispersion of the toner cores in the liquid, a surfactant may be added to the liquid, or the liquid may be stirred using a powerful stirrer (for example, "Hivis Disper Mix" manufactured by PRIMIX Corporation).

Subsequently, a basic substance (for example, an aqueous ammonia solution) is further added to the aqueous medium. The ring unopened oxazoline group content in the toner can be adjusted by controlling an amount of addition of the basic substance.

Subsequently, a temperature of the liquid containing the above-described shell material is increased to a specific holding temperature (for example, a temperature selected within a range from 50° C. to 85° C.) at a specific rate (for example, a rate selected within a range from 0.1° C./minute to 3° C./minute) while the liquid is stirred. A ring opening agent and/or the shell material (for example, the aqueous solution of the oxazoline group-containing water-soluble polymer) may be added during the above heating. Alternatively, the ring opening agent and/or the shell material (for example, the aqueous solution of the oxazoline group-containing water-soluble polymer) may be added after completion of the heating (after the temperature has reached the above holding temperature).

After completion of the heating, the temperature of the liquid is held at the above holding temperature for a specific time (for example, a time selected within a range from 30 minutes to 4 hours) while the liquid is stirred. It is thought that reaction (solidification of the shell layer) between the toner cores and the shell material proceeds while the temperature of the liquid is held at a high temperature (or being increased). For example, it is thought that the oxazoline group of the shell material reacts with a functional group of the binder resin forming the toner cores at surfaces of the toner cores, resulting in opening of the ring of the oxazoline group and formation of cross-linking structure in the shell layer. The shell layer is formed as a result of chemical bonding between the shell material and the toner cores. When the shell layer is formed on the surface of each toner core in the liquid, a dispersion of toner mother particles is obtained.

After the above formation of the shell layer, the dispersion of the toner mother particles is neutralized for example using sodium hydroxide. Subsequently, the dispersion of the toner mother particles is cooled to for example normal temperature (approximately 25° C.). Subsequently, the dispersion of the toner mother particles is filtered for example using a Buchner funnel. Through the above, the toner mother particles are separated from the liquid (solid-liquid separation), and a wet cake of the toner mother particles is obtained.

Subsequently, the toner mother particles are washed. Subsequently, the washed toner mother particles are dried. Thereafter, an external additive may be caused to adhere to surfaces of the toner mother particles as necessary by mixing the toner mother particles and the external additive using a mixer (for example, an FM mixer manufactured by Nippon Coke & Engineering Co., Ltd.). Note that in a situation in which a spray dryer is used in the drying process, the drying process and the external addition process can be performed simultaneously by spraying a dispersion of the external additive (for example, silica particles) to the toner mother particles. Through the above, a toner including a large number of toner particles is produced.

Note that processes and order of the above-described method for producing the toner may be changed as appropriate in accordance with requirements of the toner, such as in terms of structure, properties, and the like. For example, the shell material may be added to the liquid as a single addition or may be divided up and added to the liquid as a plurality of additions. Also, in a situation in which a material (for example, the shell material) is caused to react in a liquid, the material may be caused to react in the liquid for a specific time after addition of the material to the liquid. Alternatively, the material may be caused to react in the liquid while being added to the liquid over a long time. Also, the toner may be sifted after the external addition process. Also, unnecessary processes may be omitted. For example, in a situation in which a commercially available product can be used directly as a material, a process for preparing the material can be omitted by using the commercially available product. When the external additive is not caused to adhere to the surfaces of the toner mother particles (i.e., the external addition process is omitted), the toner mother particles are equivalent to the toner particles. A prepolymer may be used instead of a monomer as a material for synthesizing a resin as necessary. Also, in order to obtain a specific compound, a salt, ester, hydrate, or anhydride of the compound may be used as a raw material. In order to produce the toner efficiently, it is preferable to form a large number of toner particles at the same time. Toner particles produced at the same time are thought to have substantially the same configuration.

EXAMPLES

The following describes examples of the present disclosure. Table 1 shows toners TA-1 to TA-9 and TB-1 to TB-8 (each being an electrostatic latent image developing toner) according to the examples and comparative examples.

TABLE 1

| Toner | APES Type | APES Amount [parts by mass] | CPES Type | CPES Amount [parts by mass] | Shell layer | $NH_3$(aq) Amount [mL] |
|---|---|---|---|---|---|---|
| TA-1 | APES-1 | 35 | CPES-1 | 12 | Present | 4 |
| | APES-2 | 35 | | | | |
| TA-2 | APES-1 | 20 | CPES-1 | 12 | Present | 4 |
| | APES-2 | 50 | | | | |
| TA-3 | APES-1 | 20 | CPES-1 | 12 | Present | 6 |
| | APES-2 | 50 | | | | |
| TA-4 | APES-1 | 50 | CPES-1 | 12 | Present | 4 |
| | APES-2 | 20 | | | | |
| TA-5 | APES-1 | 50 | CPES-1 | 12 | Present | 2 |
| | APES-2 | 20 | | | | |
| TA-6 | APES-1 | 35 | CPES-2 | 12 | Present | 10 |
| | APES-2 | 35 | | | | |
| TA-7 | APES-1 | 35 | CPES-3 | 12 | Present | 10 |
| | APES-2 | 35 | | | | |
| TA-8 | APES-2 | 25 | CPES-1 | 12 | Present | None |
| | APES-3 | 45 | | | | |
| TA-9 | APES-2 | 10 | CPES-1 | 12 | Present | None |
| | APES-3 | 60 | | | | |
| TB-1 | APES-1 | 35 | CPES-4 | 12 | Present | 4 |
| | APES-2 | 35 | | | | |
| TB-2 | APES-1 | 38 | CPES-4 | 6 | Present | 4 |
| | APES-2 | 38 | | | | |
| TB-3 | APES-1 | 35 | CPES-5 | 12 | Present | 4 |
| | APES-2 | 35 | | | | |
| TB-4 | APES-1 | 38 | CPES-5 | 6 | Present | 4 |
| | APES-2 | 38 | | | | |
| TB-5 | APES-2 | 10 | CPES-5 | 12 | Present | 4 |
| | APES-3 | 60 | | | | |
| TB-6 | APES-1 | 41 | None | — | Present | 4 |
| | APES-2 | 41 | | | | |
| TB-7 | APES-1 | 20 | CPES-1 | 12 | Absent | — |
| | APES-2 | 50 | | | | |
| TB-8 | APES-4 | 70 | CPES-1 | 12 | Absent | — |

The following describes production methods, evaluation methods, and evaluation results of the toners TA-1 to TA-9 and TB-1 to TB-8 in order. Note that in evaluation in which errors may occur, an evaluation value was calculated by calculating an arithmetic mean of an appropriate number of measured values in order to ensure that any error was sufficiently small.

[Preparation of Materials]

(Synthesis of Non-Crystalline Polyester Resin APES-1)

A 1-L four-necked flask equipped with a thermometer, a nitrogen inlet glass tube, a stirrer (stainless steel stirring impeller), and a flow-down type condenser (heat exchanger) was charged with 100 g of a bisphenol A-EO (ethylene oxide) 2 mole adduct, 100 g of a bisphenol A-PO (propylene oxide) 2 mole adduct, 50 g of terephthalic acid, 30 g of adipic acid, and 54 g of tin(II) 2-ethylhexanoate. Subsequently, nitrogen gas was introduced into the flask via the nitrogen inlet tube to make a nitrogen atmosphere (inert atmosphere) inside the flask. Subsequently, the flask contents were heated to 235° C. while being stirred in the nitrogen atmosphere, and reaction (condensation polymerization reaction) of the flask contents was caused in the nitrogen atmosphere at the temperature of 235° C. while stirring the flask contents until all the resin raw materials (bisphenol A-EO 2 mole adduct, bisphenol A-PO 2 mole adduct, terephthalic acid, and adipic acid) were dissolved. Subsequently, the inside of the flask was depressurized, and reaction of the flask contents was caused in the depressurized atmosphere (absolute pressure: 8 kPa) at the temperature of 235° C. until the resultant reaction product (uncrosslinked polyester resin) has predetermined Tg and Tm (Tg: 30° C., Tm: 90° C.). Through the above, a non-crystalline polyester resin APES-1 having a glass transition point (Tg) of 30° C. and a softening point (Tm) of 90° C. was obtained.

(Synthesis of Non-Crystalline Polyester Resin APES-2)

A 1-L four-necked flask equipped with a thermometer, a nitrogen inlet glass tube, a stirrer (stainless steel stirring impeller), and a flow-down type condenser (heat exchanger) was charged with 200 g of a bisphenol A-EO (ethylene oxide) 2 mole adduct, 90 g of terephthalic acid, and 54 g of tin(II) 2-ethylhexanoate. Subsequently, nitrogen gas was introduced into the flask via the nitrogen inlet tube to make a nitrogen atmosphere (inert atmosphere) inside the flask. Subsequently, the flask contents were heated to 235° C. while being stirred in the nitrogen atmosphere, and reaction (condensation polymerization reaction) of the flask contents was caused in the nitrogen atmosphere at the temperature of 235° C. while stirring the flask contents until all the resin raw materials (bisphenol A-EO 2 mole adduct and terephthalic acid) were dissolved. Subsequently, the inside of the flask was depressurized, and reaction (specifically, polymerization reaction) of the flask contents was caused for further 1.5 hours (90 minutes) in the depressurized atmosphere (absolute pressure: 8 kPa) at the temperature of 235° C.

Subsequently, after reducing the temperature inside the flask to 210° C., 380 g (2 mole) of a cross-linking agent (trimellitic anhydride) was added into the flask, and reaction of the flask contents was caused in the depressurized atmosphere (absolute pressure: 8 kPa) at the temperature of 210° C. until the resultant reaction product (crosslinked polyester resin) has predetermined Tg and Tm (Tg: 60° C., Tm: 140° C.). Through the above, a non-crystalline polyester resin APES-2 having a glass transition point (Tg) of 60° C. and a softening point (Tm) of 140° C. was obtained.

(Synthesis of Non-Crystalline Polyester Resin APES-3)

A non-crystalline polyester resin APES-3 was synthesized by the same procedure as the synthesis of the non-crystalline polyester resin APES-1 in all aspects other than that 200 g of a bisphenol A-PO (propylene oxide) 2 mole adduct and 70 g of adipic acid were used as resin raw materials instead of the above-described resin raw materials (100 g of bisphenol A-EO 2 mole adduct, 100 g of bisphenol A-PO 2 mole adduct, 50 g of terephthalic acid, and 30 g of adipic acid). The resultant non-crystalline polyester resin APES-3 had a glass transition point (Tg) of 20° C. and a softening point (Tm) of 90° C.

(Synthesis of Non-Crystalline Polyester Resin APES-4)

A 1-L four-necked flask equipped with a thermometer, a nitrogen inlet glass tube, a stirrer (stainless steel stirring impeller), and a flow-down type condenser (heat exchanger) was charged with 200 g of a bisphenol A-PO (propylene oxide) 2 mole adduct, 70 g of adipic acid, and 54 g of tin(II) 2-ethylhexanoate. Subsequently, nitrogen gas was introduced into the flask via the nitrogen inlet tube to make a nitrogen atmosphere (inert atmosphere) inside the flask. Subsequently, the flask contents were heated to 235° C. while being stirred in the nitrogen atmosphere, and reaction (condensation polymerization reaction) of the flask contents was caused in the nitrogen atmosphere at the temperature of 235° C. while stirring the flask contents until all the resin raw materials (bisphenol A-PO 2 mole adduct and adipic acid) were dissolved. Subsequently, 20 g of a cross-linking agent (trimellitic acid) was added into the flask, the inside of the flask was depressurized, and reaction of the flask contents was caused in the depressurized atmosphere (absolute pressure: 8 kPa) at the temperature of 235° C. until the resultant reaction product (crosslinked polyester resin) has predetermined Tg and Tm (Tg: 30° C., Tm: 90° C.). Through the above, a non-crystalline polyester resin APES-4 having a glass transition point (Tg) of 30° C. and a softening point (Tm) of 90° C. was obtained.

(Synthesis of Crystalline Polyester Resin CPES-1)

A 1-L four-necked flask equipped with a thermometer, a nitrogen inlet glass tube, a stirrer (stainless steel stirring impeller), and a flow-down type condenser (heat exchanger) was charged with 69 g of ethylene glycol, 214 g of sebacic acid, and 54 g of tin(II) 2-ethylhexanoate. Subsequently, the flask was placed on a heating mantle, and nitrogen gas was introduced into the flask via the nitrogen inlet tube to make a nitrogen atmosphere (inert atmosphere) inside the flask. Subsequently, the flask contents were heated to 235° C. over two hours while being stirred in the nitrogen atmosphere. After completion of the heating, reaction (condensation polymerization reaction) of the flask contents was caused in the nitrogen atmosphere at the temperature of 235° C. while stirring the flask contents until a reaction rate becomes 95% or higher. The reaction rate was calculated in accordance with an expression "reaction rate=100×(actual amount of water generated by the reaction)/(theoretical amount of water generated by the reaction)".

Subsequently, the flask contents were cooled to 160° C., and a liquid mixture of 156 g of styrene, 195 g of n-butyl methacrylate, and 0.5 g of di-tert-butyl peroxide was dripped into the flask over one hour. After the dripping, the temperature of the flask contents was maintained at 160° C. and the flask contents were stirred for further 30 minutes (maturing process). Subsequently, the inside of the flask was heated and depressurized, and reaction of the flask contents was caused for one hour in the depressurized atmosphere (absolute pressure: 8 kPa) at a temperature of 200° C., thereafter the inside of the flask was cooled to 180° C. Subsequently, the inside of the flask was restored to normal pressure, and a radical polymerization inhibitor (4-tert-butylcatechol) was added into the flask. The flask contents were heated to 210° C. over two hours and caused to react for one hour at the temperature of 210° C. Subsequently, the inside of the flask was depressurized, and the flask contents were caused to react for two hours in the depressurized atmosphere (pressure: 40 kPa) at the temperature of 210° C. Through the above, a crystalline polyester resin CPES-1 having a melting point (Mp) of 68° C. was obtained.

(Synthesis of Crystalline Polyester Resin CPES-2)

A crystalline polyester resin CPES-2 was synthesized by the same procedure as the synthesis of the crystalline polyester resin CPES-1 in all aspects other than that 100 g of 1,4-butanediol was used instead of 69 g of ethylene glycol. The resultant crystalline polyester resin CPES-2 had a melting point (Mp) of 74° C.

(Synthesis of Crystalline Polyester Resin CPES-3)

A crystalline polyester resin CPES-3 was synthesized by the same procedure as the synthesis of the crystalline polyester resin CPES-1 in all aspects other than that 131 g of 1,6-hexanediol was used instead of 69 g of ethylene glycol. The resultant crystalline polyester resin CPES-3 had a melting point (Mp) of 78° C.

(Synthesis of Crystalline Polyester Resin CPES-4)

A crystalline polyester resin CPES-4 was synthesized by the same procedure as the synthesis of the crystalline polyester resin CPES-1 in all aspects other than that 224 g of 1,12-dodecanediol was used instead of 69 g of ethylene glycol. The resultant crystalline polyester resin CPES-4 had a melting point (Mp) of 86° C.

(Synthesis of Crystalline Polyester Resin CPES-5)

A crystalline polyester resin CPES-5 was synthesized by the same procedure as the synthesis of the crystalline polyester resin CPES-1 in all aspects other than that the liquid mixture of 156 g of styrene, 195 g of n-butyl methacrylate, and 0.5 g of di-tert-butylperoxide was not used (the above-described dripping and maturing process were not performed). The resultant crystalline polyester resin CPES-5 had a melting point (Mp) of 68° C.

The crystalline polyester resins CPES-1 to CPES-5 each had a crystallinity index of at least 0.90 and no greater than 1.15.

[Method for Producing Toner]

(Production of Toner Cores)

An FM mixer ("FM-20B" manufactured by Nippon Coke & Engineering Co., Ltd.) was used to mix non-crystalline polyester resins (any of the non-crystalline polyester resins APES-1 to APES-4 specified for each toner) of types and amounts indicated at "APES" in Table 1, a crystalline polyester resin (any of the crystalline polyester resins CPES-1 to CPES-5 specified for each toner) of a type and an amount indicated at "CPES" in Table 1, 9 parts by mass of a releasing agent (ester wax: "NISSAN ELECTOL (registered Japanese trademark) WEP-8" manufactured by NOF Corporation), and 9 parts by mass of a colorant (carbon black: "MA-100" manufactured by Mitsubishi Chemical Corporation).

For example, in production of the toner TA-1, 35 parts by mass of the non-crystalline polyester resin APES-1, 35 parts by mass of the non-crystalline polyester resin APES-2, 12 parts by mass of the crystalline polyester resin CPES-1, 9 parts by mass of the releasing agent (NISSAN ELECTOL WEP-8), and 9 parts by mass of the colorant (MA-100) were mixed. Also, in production of the toner TB-6, no crystalline polyester resin was used, and 41 parts by mass of the non-crystalline polyester resin APES-1, 41 parts by mass of the non-crystalline polyester resin APES-2, 9 parts by mass of the releasing agent (NISSAN ELECTOL WEP-8), and 9 parts by mass of the colorant (MA-100) were mixed.

Subsequently, the resultant mixture was melt-kneaded using a twin-screw extruder ("PCM-30" manufactured by Ikegai Corp.) under conditions of a material feeding speed of 100 g/minute, a shaft rotational speed of 150 rpm, and a cylinder temperature of 100° C. Thereafter, the resultant kneaded product was cooled. Subsequently, the cooled kneaded product was coarsely pulverized using a pulverizer ("ROTOPLEX" (registered Japanese trademark) manufactured by Hosokawa Micron Corporation) under conditions of a set particle diameter of 2 mm. Subsequently, the resultant coarsely pulverized product was finely pulverized using a pulverizer ("Turbo Mill model RS" manufactured by FREUND-TURBO CORPORATION). Subsequently, the resultant finely pulverized product was classified using a classifier (classifier using Coanda effect, "Elbow Jet Type EJ-LABO" manufactured by Nittetsu Mining Co., Ltd.). Through the above, toner cores having a volume median diameter ($D_{50}$) of 6.7 μm were obtained.

After the above-described production of the toner cores, formation of the shell layer was carried out. However, in production of each of the toners TB-7 and TB-8, the above-described toner cores were used as the toner mother particles without carrying out a shell layer formation process, a washing process, and a drying process described below.

(Shell Layer Formation Process)

A 1-L three-necked flask equipped with a thermometer and a stirring impeller was set in a water bath and charged with 100 mL of ion exchanged water. Thereafter, a temperature inside the flask was maintained at 30° C. using the water bath. Subsequently, 10 g of an aqueous solution of an oxazoline group-containing polymer ("EPOCROS WS-300"

manufactured by Nippon Shokubai Co., Ltd., solid concentration: 10% by mass) was added into the flask, and then the flask contents were sufficiently stirred. Subsequently, 100 g of the toner cores produced by the above-described procedure were added into the flask, and the flask contents were stirred for one hour at a rotational speed of 200 rpm. Thereafter, 100 mL of ion exchanged water was added into the flask.

Subsequently, 1% by mass aqueous ammonia solution was added into the flask in an amount indicated at "$NH_3$ (aq)" in Table 1. For example, in production of the toner TA-1, 4 mL of the aqueous ammonia solution was added into the flask. Also, in production of the toner TA-3, 6 mL of the aqueous ammonia solution was added into the flask. Also, in production of each of the toners TA-8 and TA-9, the aqueous ammonia solution was not added into the flask.

Subsequently, the temperature inside the flask was increased to 60° C. at a rate of 0.5° C./minute while stirring the flask contents at a rotational speed of 150 rpm. Subsequently, the temperature (60° C.) was maintained for one hour while stirring the flask contents at a rotational speed of 100 rpm.

Subsequently, pH of the flask contents was adjusted to 7 by adding a 1% by mass aqueous ammonia solution into the flask. Subsequently, the flask contents were cooled to normal temperature (approximately 25° C.). Through the above, a dispersion containing toner mother particle was obtained.

(Washing Process)

The dispersion of the toner mother particles obtained as described above was filtered (subjected to solid-liquid separation) using a Buchner funnel to collect a wet cake of the toner mother particles. Thereafter, the collected wet cake of the toner mother particles was re-dispersed in ion exchanged water. The dispersion and filtration were repeated five times to wash the toner mother particles.

(Drying Process)

Subsequently, the toner mother particles were dried using a continuous type surface modifier ("COATMIZER (registered Japanese trademark)" manufactured by Freund Corporation) under conditions of a hot air temperature of 45° C. and a blower flow rate of 2 $m^3$/minute. Through the above, a powder of the toner mother particles was obtained.

(External Addition Process)

Subsequently, the obtained toner mother particles were subjected to external addition. Specifically, 100 parts by mass of the toner mother particles and 1 part by mass of positively chargeable silica particles ("AEROSIL (registered Japanese trademark) REA90" manufactured by Nippon Aerosil Co., Ltd., content: dry silica particles to which positive chargeability is imparted by surface treatment, number average primary particle diameter: 20 nm) were mixed for five minutes using a 10-L FM mixer (product of Nippon Coke & Engineering Co., Ltd.) to cause the external additive (silica particles) to adhere to surfaces of the toner mother particles. Subsequently, the resultant powder was sifted using a 200-mesh sieve (opening: 75 μm). Through the above, a toner (each of the toners TA-1 to TA-9 and TB-1 to TB-8 shown in Table 1) including a large number of toner particles was obtained.

Table 2 shows measurement results of an endothermic energy amount $\Delta H_{PES}$ (endothermic energy amount due to melting of portions in which the crystalline polyester resin in the toner cores is crystallized, which amount was determined by differential scanning calorimetry of the toner) of the toner, Tg (glass transition point) of the toner, a loss tangent tan $\delta_{60}$ of the toner (loss tangent of the toner at 60° C.), a loss tangent tan $\delta_{100}$ of the toner (loss tangent of the toner at 100° C.), a loss tangent tab $\delta_{160}$ of the toner (loss tangent of the toner at 160° C.), a loss tangent tan $\delta_{200}$ of the toner (loss tangent of the toner at 200° C.), and a ring unopened oxazoline group content of the toner (amount of a ring unopened oxazoline group contained in 1 g of the toner).

TABLE 2

| Toner | $\Delta H_{PES}$ [mJ/mg] | Tg [° C.] | Loss tangent tanδ 60° C. | 100° C. | 160° C. | 200° C. | Ring unopened oxazoline group Amount [μmol/g] |
|---|---|---|---|---|---|---|---|
| TA-1 | 0.1 | 29 | 2.10 | 2.00 | 0.43 | 0.24 | 532 |
| TA-2 | 0.2 | 36 | 1.50 | 1.70 | 0.45 | 0.21 | 563 |
| TA-3 | 0.2 | 37 | 1.20 | 1.00 | 0.47 | 0.36 | 311 |
| TA-4 | 0.1 | 23 | 2.70 | 2.10 | 0.42 | 0.23 | 578 |
| TA-5 | 0.1 | 22 | 2.90 | 2.50 | 0.39 | 0.12 | 655 |
| TA-6 | 0.4 | 31 | 1.90 | 2.90 | 0.49 | 0.46 | 45 |
| TA-7 | 0.8 | 35 | 1.50 | 3.10 | 0.48 | 0.44 | 86 |
| TA-8 | 0.2 | 19 | 3.20 | 3.80 | 0.31 | 0.03 | 758 |
| TA-9 | 0.3 | 12 | 3.80 | 3.70 | 0.37 | 0.08 | 762 |
| TB-1 | 5.2 | 35 | 0.79 | 1.23 | 0.43 | 0.25 | 541 |
| TB-2 | 1.8 | 42 | 0.55 | 0.99 | 0.39 | 0.23 | 527 |
| TB-3 | 7.5 | 51 | 0.29 | 0.89 | 0.48 | 0.27 | 543 |
| TB-4 | 3.4 | 50 | 0.33 | 0.76 | 0.41 | 0.22 | 536 |
| TB-5 | 7.4 | 28 | 1.60 | 2.60 | 0.47 | 0.28 | 511 |
| TB-6 | 0.0 | 50 | 0.21 | 0.33 | 0.41 | 0.25 | 566 |
| TB-7 | 0.2 | 37 | 1.40 | 1.10 | 2.60 | 4.80 | 0 |
| TB-8 | 0.1 | 27 | 0.80 | 0.90 | 0.42 | 0.39 | 0 |

For example, the toner TA-1 had an endothermic energy amount $\Delta H_{PES}$ of 0.1 mJ/mg, Tg of 29° C., a loss tangent tan $\delta_{60}$ of 2.10, a loss tangent tan $\delta_{100}$ of 2.00, a loss tangent tan $\delta_{160}$ of 0.43, a loss tangent tan $\delta_{200}$ of 0.24, and a ring unopened oxazoline group content of 532 μmol/g. These were measured by methods described below.

<Method for Measuring Glass Transition Point and Endothermic Energy Amount $\Delta H_{PES}$>

First, 0.1 mg of a sample (toner) and 50 mL of hexane were put in a 50-mL screw vial. Subsequently, the screw vial was set in an ultrasonic cleaner ("US-18KS" manufactured by SND Co., Ltd., tank capacity: 18 L, high-frequency output: 360 W, oscillating method: self-excited oscillation by BLT (Langevin type oscillator fastened by bolt), oscillatory frequency: 38 kHz). Subsequently, ultrasonic treatment was performed for three minutes using the ultrasonic cleaner to obtain a toner dispersion. Thereafter, the obtained toner dispersion was filtered (subjected to solid-liquid separation) using a Buchner funnel. Subsequently, the resultant toner was put again in a 50-mL screw vial together with 50 mL of hexane, and the above-described three-minute ultrasonic treatment was performed. The above-described addition of the toner to hexane, ultrasonic treatment, and solid-liquid separation were repeated in total of three times to sufficiently remove the releasing agent in the toner particles.

A differential scanning calorimeter ("DSC-6220" manufactured by Seiko Instruments Inc.) was used as a measuring device. First, 10 mg of a sample (toner) was placed in an aluminum pan (aluminum container), and the aluminum pan was set in the measuring device. A heat absorption curve (vertical axis: heat flow (DSC signal), horizontal axis: temperature) of the toner was plotted using the measuring device under conditions of a temperature set range from 5° C. to 200° C. and a heating rate of 10° C./minute. Tg (glass transition point) and an endothermic energy amount $\Delta H_{PES}$ of the toner were read from the plotted heat absorption curve. For example, in the heat absorption curve, a temperature at an inflection point (intersection point of an extrapolation line of a baseline and an extrapolation line of an inclined portion of the curve) due to glass transition corresponds to Tg (glass transition point) of the toner. Also, the endothermic energy amount $\Delta H_{PES}$ due to melting of crystallized portions (specifically, portions in which the crystalline polyester resin was crystallized) in the toner particles was determined from an area of a heat absorption curve.

<Method for Measuring Loss Tangents Tan $\delta_{60}$, Tan $\delta_{100}$, Tan $\delta_{160}$, and Tan $\delta_{200}$>

First, 0.1 g of a sample (toner) was set in a pelleting machine, and a cylindrical pellet having a diameter of 10 mm and a thickness of 1.5 mm was obtained by applying a pressure of 4 MPa to the toner. The obtained pellet was set in a measuring device. A rheometer ("PhysicaMCR-301" manufactured by Anton Paar GmbH) was used as the measuring device. A measurement jig (parallel plate) was attached to a distal end of a shaft (specifically, a shaft driven by a motor) of the measuring device. The pellet was placed on a plate (specifically, a heater board heated by a heater) of the measuring device. The pellet on the plate was heated to 110° C. to melt the pellet (a mass of the toner). When the toner melted completely, the measurement jig (parallel plate) was moved from above into close contact with the melted toner to interpose the toner between the two parallel plates (upper plate: measurement jig, lower plate: heater board). Then, the toner was cooled to 40° C. Subsequently, dynamic viscoelasticity of the sample (toner) was measured using the measuring device under conditions of a measurement temperature range from 40° C. to 200° C., a heating rate of 2° C./minute, a vibration frequency of 1 Hz, and strain of 1%. Specifically, a loss tangent tan $\delta_{60}$ (loss tangent of the toner at 60° C.), a loss tangent tan $\delta_{100}$ (loss tangent of the toner at 100° C.), a loss tangent tan $\delta_{160}$ (loss tangent of the toner at 160° C.), and a loss tangent tan $\delta_{200}$ (loss tangent of the toner at 200° C.) were measured as the dynamic viscoelasticity of the sample (toner).

<Method for Measuring Ring Unopened Oxazoline Group Content>

A ring unopened oxazoline group content (amount of a ring unopened oxazoline group contained in 1 g of the toner) was measured by gas chromatography-mass spectrometry (GC/MS method). In the GC/MS method, a gas chromatograph mass spectrometer ("GCMS-QP 2010 Ultra" manufactured by Shimadzu Corporation) and a multi-shot pyrolizer ("FRONTIER LAB MULTI-FUNCTIONAL PYROLYZER (registered Japanese trademark) PY-3030D" manufactured by Frontier Laboratories Ltd.) were used as measuring devices. A GC column ("AGILENT (registered Japanese trademark) J&W Ultra-inert Capillary GC Column DB-5 ms" manufactured by Agilent Technologies Japan, Ltd., phase: allylene phase having a polymer main chain strengthened by introducing allylene to siloxane, inner diameter: 0.25 mm, film thickness: 0.25 μm, length: 30 m) was used as a column.

(Gas Chromatography)

Carrier gas: helium (He) gas

Carrier flow rate: 1 mL/minute

Vaporizing chamber temperature: 210° C.

Thermal decomposition temperature: heating furnace "600° C.", interface portion "320° C."

Heating condition: after being kept at 40° C. for three minutes, temperature was increased to 320° C. from 40° C. at a heating rate of 10° C./minute, and kept at 320° C. for 15 minutes (Mass Analysis)

Ionizing method: electron impact (EI) method

Ion source temperature: 200° C.

Interface portion temperature: 320° C.

Detection mode: scan (measurement range: 45 m/z to 500 m/z)

A peak derived from a ring unopened oxazoline group was determined through analysis of a mass spectrum measured under the above conditions. An amount of the ring unopened oxazoline group contained in the measurement target (toner) (i.e., amount of the ring unopened oxazoline group contained in 1 g of the toner) was determined on the basis of a peak area in the measured chromatogram. A calibration curve was used for quantification.

[Evaluation Methods]

Each sample (each of the toners TA-1 to TA-9 and TB-1 to TB-8) was evaluated by methods described below.

(Heat-Resistant Preservability)

First, 2 g of the sample (toner) was placed in a 20-mL polyethylene container, and the container was left for three hours in a thermostatic chamber set at 58° C. Thereafter, the toner was taken out of the thermostatic chamber, and cooled at 20° C. for three hours to obtain an evaluation toner.

Subsequently, the obtained evaluation toner was placed on a 100-mesh sieve (opening: 150 μm) of a known mass. A mass of the toner on the sieve (i.e., a mass of the toner before sifting) was determined by measuring a total mass of the sieve and the evaluation toner thereon. Subsequently, the sieve was set in a powder tester (product of Hosokawa Micron Corporation), and the evaluation toner was sifted by vibrating the sieve for 30 seconds under conditions of a rheostat level of 5 in accordance with a manual of the powder tester. After the sifting, a mass of the toner remaining on the sieve (i.e., mass of the toner after the sifting) was determined by measuring a total mass of the sieve and the toner thereon. An aggregation rate (unit: % by mass) was determined from the mass of the toner before the sifting and the mass of the toner after the sifting in accordance with the following expression.

$$\text{Aggregation rate} = 100 \times (\text{mass of toner after sifting}) / (\text{mass of toner before sifting})$$

An aggregation rate lower than 10% by mass was evaluated as "good", and an aggregation rate of 10% by mass or higher was evaluated as "poor".

(Low-Temperature Fixability and Hot Offset Resistance)

A two-component developer was prepared by mixing 100 parts by mass of a developer carrier (carrier for FS-05250DN) and 5 parts by mass of the sample (toner) for 30 minutes using a ball mill.

An image was formed using the two-component developer prepared as above to evaluate a lowest fixing temperature and a highest fixing temperature. A printer ("FS-05250DN" manufactured by KYOCERA Document Solutions Inc. and modified to enable change of fixing temperature) including a roller-roller type heat-pressure fixing device was used as an evaluation apparatus. The two-component developer prepared as above was loaded into a developing device of the evaluation apparatus, and the sample (toner for replenishment use) was loaded into a toner container of the evaluation apparatus.

A solid image (specifically, an unfixed toner image) of a size of 25 mm×25 mm was formed using the evaluation apparatus in an environment at a temperature of 23° C. and a relative humidity of 55% RH under conditions of a linear velocity of 200 mm/second and a toner application amount of 1.0 mg/cm$^2$. The image was formed on paper ("C$^2$90" manufactured by Fuji Xerox Co., Ltd., plain paper of A4 size and 90 g/m$^2$) by leaving a margin of 10 mm from a trailing edge of the paper. Subsequently, the paper on which the image had been formed was passed through the fixing device of the evaluation apparatus.

In evaluation of the lowest fixing temperature, a measurement range of the fixing temperature was from 90° C. to 150° C. A lowest temperature (a lowest fixing temperature) at which the solid image (toner image) was fixable to the paper was measured by increasing the fixing temperature of the fixing device from 90° C. in increments of 2° C. Whether or not the toner was fixable was checked by a fold-rubbing test described below. Specifically, the evaluation paper passed through the fixing device was folded such that a surface on which the image was formed was folded inwards, and a 1-kg weight covered by cloth was rubbed back and forth five times on the image on the fold. Then, the paper was unfolded, and the folded part (part in which the solid image was formed) of the paper was observed. A length (peeling length) of toner peeling in the folded part was measured. A lowest temperature among fixing temperatures for which the peeling length was not longer than 1 mm was determined to be the lowest fixing temperature. A lowest fixing temperature lower than 110° C. was evaluated as "good", and a lowest fixing temperature of 110° C. or higher was evaluated as "poor".

In evaluation of the highest fixing temperature, a measurement range of the fixing temperature was from 150° C. to 250° C. A highest temperature (highest fixing temperature) at which offset does not occur was measured by increasing the fixing temperature of the fixing device from 150° C. by increments of 2° C. Whether or not offset occurred (the toner adhered to a fixing roller) in the paper passed through the fixing device was checked by visual observation. A highest fixing temperature of 170° C. or higher was evaluated as "good", and a highest fixing temperature lower than 170° C. was evaluated as "poor".

[Evaluation Results]

Table 3 shows evaluation results of each of the toners TA-1 to TA-9 and TB-1 to TB-8. Table 3 shows measurement values of low-temperature fixability (lowest fixing temperature), hot offset resistance (highest fixing temperature), and heat-resistant preservability (aggregation rate).

TABLE 3

| | Toner | Low-temperature fixability [° C.] | Hot offset resistance [° C.] | Heat-resistant preservability [% by mass] |
|---|---|---|---|---|
| Example 1 | TA-1 | 100 | 200 | 3 |
| Example 2 | TA-2 | 106 | 220 | 1 |
| Example 3 | TA-3 | 104 | 180 | 7 |
| Example 4 | TA-4 | 96 | 180 | 9 |
| Example 5 | TA-5 | 100 | 230 | 2 |
| Example 6 | TA-6 | 100 | 190 | 2 |
| Example 7 | TA-7 | 100 | 180 | 1 |
| Example 8 | TA-8 | 104 | 220 | 7 |
| Example 9 | TA-9 | 106 | 220 | 9 |
| Comparative example 1 | TB-1 | 112 (poor) | 200 | 1 |
| Comparative example 2 | TB-2 | 120 (poor) | 210 | 3 |
| Comparative example 3 | TB-3 | 112 (poor) | 200 | 2 |
| Comparative example 4 | TB-4 | 118 (poor) | 200 | 1 |
| Comparative example 5 | TB-5 | 112 (poor) | 200 | 4 |
| Comparative example 6 | TB-6 | 130 (poor) | 190 | 1 |
| Comparative example 7 | TB-7 | 102 | 160 (poor) | 88 (poor) |
| Comparative example 8 | TB-8 | 116 (poor) | 200 | 76 (poor) |

The toners TA-1 to TA-9 (toners of Examples 1 to 9) each had the above-described basic features. The toners TA-1 to TA-9 each included a plurality of toner particles. The toner particles each included a toner core and a shell layer covering a surface of the toner core. The toner core contained a crystalline polyester resin and non-crystalline polyester resins. The toner core contained as the non-crystalline polyester resins, a crosslinked non-crystalline polyester resin and an uncrosslinked non-crystalline polyester resin (see Table 1). The non-crystalline polyester resins APES-1 and APES-3 were each an uncrosslinked non-crystalline polyester resin. The non-crystalline polyester resins APES-2 and APES-4 were each a crosslinked non-crystalline polyester resin. In the differential scanning calorimetry of the toner, an endothermic energy amount due to melting of portions in which the crystalline polyester resin was crystallized was at least 0.0 mJ/mg and no greater than 1.0 mJ/mg (see Table 2). The shell layer contained a resin that has a repeating unit including the oxazoline group (see the "Shell Layer Formation Process" described above). The toner had a glass transition point of at least 10° C. and no greater than 40° C. (see Table 2). The loss tangent of the toner at 60° C. was at least 1.00 and no greater than 4.00 (see Table 2). The loss tangent of the toner at 100° C. was at least 1.00 and no greater than 4.00 (see Table 2). The loss tangent of the toner at 160° C. was at least 0.01 and no greater than 0.50 (see Table 2). The loss tangent of the toner at 200° C. was at least 0.01 and no greater than 0.50 (see Table 2).

Note that in the toner TA-2, the amount of the crystalline polyester resin (CPES-1) in the toner core was 17 parts by mass (=12×100/70) relative to 100 parts by mass of the non-crystalline polyester resins (APES-1 and APES-2) in the toner core (see Table 1). Also, the amount of the uncrosslinked non-crystalline polyester resin (APES-1) in the toner core was 0.4 times (=20/50) the amount of the crosslinked non-crystalline polyester resin (APES-2) in the toner core (see Table 1). Through observation of cross sections of the toner particles using a transmission electron microscope (TEM), it was found that a thickness of the shell layer of each of the toners TA-1 to TA-9 was at least 1 nm and no greater than 20 nm. Through analysis of SEM images, it was found that a shell coverage of each of the toners TA-1 to TA-9 was from 95% to 100%.

As shown in Table 3, each of the toners TA-1 to TA-9 (toners of Examples 1 to 9) was excellent in all of low-temperature fixability, hot offset resistance, and heat-resistant preservability.

A reason for poor low-temperature fixability of the toner TB-5 is supposed to be an excessively large endothermic energy amount $\Delta H_{PES}$ of the toner TB-5 (see Table 2). Specifically, it is thought that heat supplied from a heating roller of the fixing device to the toner was consumed by melting of portions in which the crystalline polyester resin in the toner cores was crystallized, resulting in decrease in heat quantity that causes softening of the toner.

What is claimed is:

1. A toner including a plurality of toner particles, wherein the toner particles each include a toner core and a shell layer covering a surface of the toner core, the toner core contains a crystalline polyester resin and non-crystalline polyester resins, the toner core contains, as the non-crystalline polyester resins, a crosslinked non-crystalline polyester resin and an uncrosslinked non-crystalline polyester resin, in differential scanning calorimetry of the toner, an endothermic energy amount due to melting of portions in which the crystalline polyester resin is crystallized is at least 0.0 mJ/mg and no greater than 1.0 mJ/mg, the shell layer contains a resin that has a repeating unit including an oxazoline group, the toner has a glass transition point of at least 10° C. and no greater than 40° C., a loss tangent of the toner at 60° C. is at least 1.00 and no greater than 4.00, a loss tangent of the toner at 100° C. is at least 1.00 and no greater than 4.00, a loss tangent of the toner at 160° C. is at least 0.01 and no greater than 0.50, and a loss tangent of the toner at 200° C. is at least 0.01 and no greater than 0.50.

2. The toner according to claim 1, wherein the crystalline polyester resin is a polymer of monomers including at least one α,ω-alkanediol having a carbon number of at least 1 and no greater than 8, at least one α,ω-alkane dicarboxylic acid having a carbon number of at least 6 and no greater than 14, at least one styrene-based monomer, and at least one acrylic acid-based monomer.

3. The toner according to claim 2, wherein the crosslinked non-crystalline polyester resin is a polymer of monomers including at least one bisphenol, at least one aromatic dicarboxylic acid, and at least one tribasic carboxylic acid, and the uncrosslinked non-crystalline polyester resin is a polymer of monomers including at least one bisphenol and at least one α,ω-alkane dicarboxylic acid having a carbon number of at least 4 and no greater than 10.

4. The toner according to claim 3, wherein an amount of the crystalline polyester resin in the toner cores is at least 10 parts by mass and no greater than 25 parts by mass relative to 100 parts by mass of the non-crystalline polyester resins in the toner cores, and an amount of the uncrosslinked non-crystalline polyester resin in the toner cores is at least 0.3 times and no greater than 3.0 times an amount of the crosslinked non-crystalline polyester resin in the toner cores.

5. The toner according to claim 3, wherein the aromatic dicarboxylic acid is a terephthalic acid, the tribasic carboxylic acid is a trimellitic acid, and the α,ω-alkane dicarboxylic acid is an adipic acid.

6. The toner according to claim 2, wherein the crosslinked non-crystalline polyester resin is a polymer of monomers including at least one bisphenol, at least one aromatic dicarboxylic acid, and at least one tribasic carboxylic acid, and the uncrosslinked non-crystalline polyester resin is a polymer of monomers including at least two bisphenols, at least one aromatic dicarboxylic acid, and at least one α,ω-alkane dicarboxylic acid having a carbon number of at least 4 and no greater than 10.

7. The toner according to claim 6, wherein an amount of the crystalline polyester resin in the toner cores is at least 10 parts by mass and no greater than 25 parts by mass relative to 100 parts by mass of the non-crystalline polyester resins in the toner cores, and an amount of the uncrosslinked non-crystalline polyester resin in the toner cores is at least 0.3 times and no greater than 3.0 times an amount of the crosslinked non-crystalline polyester resin in the toner cores.

8. The toner according to claim 6, wherein the aromatic dicarboxylic acid is a terephthalic acid, the tribasic carboxylic acid is a trimellitic acid, and the α,ω-alkane dicarboxylic acid is an adipic acid.

9. The toner according to claim 1, wherein the resin that has the repeating unit including the oxazoline group is a copolymer of at least two vinyl compounds including a compound represented by the following formula (1)

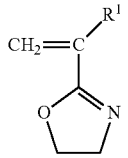

(1)

where in the formula (1), $R^1$ represents a hydrogen atom or an optionally substituted alkyl group.

10. The toner according to claim 1, wherein an amount of a ring unopened oxazoline group contained in 1 g of the toner is at least 30 μmol/g and no greater than 770 μmol/g, the amount of the ring unopened oxazoline group being measured by gas chromatography-mass spectrometry.

11. The toner according to claim 1, wherein the toner core is a pulverized core, and the toner core does not contain an oxazoline group.

* * * * *